US007882974B2

(12) United States Patent
Evans et al.

(10) Patent No.: US 7,882,974 B2
(45) Date of Patent: Feb. 8, 2011

(54) FOOD CONTAINER ASSEMBLY WITH INTEGRAL HINGE/LATCH COMBINATION AND METHOD THEREFOR

(75) Inventors: Michael G Evans, Cincinnati, OH (US); Matthew J Wichmann, Crescent Springs, KY (US); Ashish K Mithal, North Chelmsford, MA (US)

(73) Assignee: Waddington North America, Inc., Chelmsford, MA (US)

( * ) Notice: Subject to any disclaimer, the term of this patent is extended or adjusted under 35 U.S.C. 154(b) by 1270 days.

(21) Appl. No.: 11/328,322

(22) Filed: Jan. 9, 2006

(65) Prior Publication Data

US 2006/0157483 A1 Jul. 20, 2006

Related U.S. Application Data

(60) Provisional application No. 60/643,884, filed on Jan. 14, 2005.

(51) Int. Cl.
*B65D 6/28* (2006.01)

(52) U.S. Cl. ..... 220/4.24; 220/4.22; 220/324

(58) Field of Classification Search ..... 220/4.21, 220/4.22, 4.24

See application file for complete search history.

(56) References Cited

U.S. PATENT DOCUMENTS 3,767,110 A * 10/1973 Congleton ..... 220/4.23
4,061,241 A * 12/1977 Retelny ..... 220/4.21
4,079,880 A * 3/1978 Edwards ..... 220/4.21
4,089,467 A 5/1978 Makowicki
4,615,464 A 10/1986 Byrns
4,787,552 A * 11/1988 Natori ..... 220/4.23
5,094,355 A 3/1992 Clark et al.
5,096,084 A * 3/1992 Wells ..... 220/835
5,205,413 A * 4/1993 Cautereels et al. ..... 206/541
5,860,530 A 1/1999 Simmons et al.
6,415,947 B1 7/2002 Kim
6,733,852 B2 5/2004 Littlejohn et al.

FOREIGN PATENT DOCUMENTS

FR 2678584 1/1993

OTHER PUBLICATIONS

"Adaptables Packaging", [online] [retrieved on May 8, 2006] Retrieved from the internet <URL:http://www.gp.com/dixiefs/togo/adaptables.html>, pp. 1-2.

* cited by examiner

*Primary Examiner*—Harry A Grosso
(74) *Attorney, Agent, or Firm*—Vern Maine & Associates

(57) ABSTRACT

The present invention relates to a food container assembly comprising a base and a lid wherein the base and the lid are structurally identical in one of the embodiments. The base and the lid include inter-cooperating sealing areas in the form of ridges and mating grooves. The base and the lid can be joined via a first hinge/latch combination in a mutually hinge-able relationship along a pair of corresponding sides, and in addition, can be mutually secured along an opposing pair of corresponding sides via a second hinge/latch combination. According to one embodiment of the invention, the container base includes a bottom wall; a sidewall; and a peripheral rim having a ridge portion, a groove portion, a hinge flap and a locking area; wherein the container base is adapted for engagement and latching with another identical container base disposed in an inverted and superjacent relationship therewith.

18 Claims, 9 Drawing Sheets

FOOD CONTAINER ASSEMBLY WITH INTEGRAL HINGE/LATCH COMBINATION AND METHOD THEREFOR

CROSS REFERENCE TO RELATED APPLICATIONS

This application claims the benefit under 35 U.S.C. 119(e) of U.S. Provisional Patent Application Ser. No. 60/643,884, filed on Jan. 14, 2005, which is incorporated herein by reference for all purposes.

FIELD OF THE INVENTION

This invention relates generally to food containers. More particularly, this invention relates to a food container assembly comprising a base and a lid, wherein the base and the lid can be fastened via a first hinge/latch combination in a mutually hingeable relationship along a pair of corresponding sides, and, in addition, can be mutually secured along opposing pair of corresponding sides via a second hinge/latch combination.

BACKGROUND OF THE INVENTION

Disposable food containers are well known and are ubiquitously employed in all food related industries, restaurants, caterers, institutional food service establishments, hospital cafeterias, and households. A survey of the field yields a variety of containers for storing, transporting, or serving food in the form of plates, bowls, trays, clamshells etc. Existing food containers fall essentially into two broad categories, namely, one-piece hinged containers and two-piece containers.

A popular type of disposable food container is a hinged one-piece takeout container having a clamshell configuration. These containers are typically made by thermoforming a sheet of plastic material into two adjacent trays interconnected by a material bridge, which acts as a living hinge. The two adjacent trays are disposed on either side of the living hinge and respectively define a bottom container tray and a top lid tray. The container is held closed by some type of latching mechanism.

Hinged one-piece clamshell containers may be constructed from foam materials including expanded polystyrene (EPS). The latching mechanism on foam clamshell containers typically comprises at least one tab-shaped projection incorporated into the top lid tray that engages with a corresponding slot or recess in the bottom container tray. Foam clamshell containers are one of the cheapest solutions of the industry and are not considered upscale enough for use by a majority of image-conscious food service establishments and restaurant chains.

A disadvantage of one-piece hinged takeout containers is that they are awkward or cumbersome to handle when used as a dining dish. In their open configuration the permanently attached lid and the tray of a typical one-piece hinged takeout container utilize a relatively large area on the table surface. Also, eating out of a utilitarian container package having a permanently attached lid is not conducive of conveying to the consumer an ambiance of upscale dining experience and affects the image of the restaurant or food service establishment utilizing such a package. Nonetheless a number of food-service establishments do prefer a one piece hinged container because it obviates the need to stock two components and also avoids the risk of running out of one of the container components. In addition, using a one-piece hinged container is operationally simpler and inherently prevents—receiving the wrong lids; having an inadequate lid fit; or inadvertently mismatching the container and the lid. In recent years hinged lid container use has grown particularly in two color configurations with a black or colored base connected to a clear lid. However, utilizing a one-piece container does require that even customers who have no need for a lid (such as eat-in customers) must take a lid, which is both wasteful and costly.

Due to some of the inherent disadvantages of one-piece containers and the generally less-than-upscale image associated therewith, two-piece containers are also utilized in the marketplace.

Two-piece containers typically comprise a serving platter or base that can be sealed against or at least engaged with a cooperating lid or cover. The base usually has an upwardly projecting sidewall terminating into a rim. The lid is configured to fit the base and may include a dome shaped central portion to comfortably accommodate food within the base. The base rim may further include sealing ridges, channels, tabs, flared areas or similar features that are adapted for cooperative engagement with the corresponding grooves, notches, inverted channels, slots or the like integrated with the lid or cover.

One of the problems with two-piece containers is that the food service establishment has to carry two separate items in the form of a base container and its corresponding cover or lid. Thus, a typical restaurant ends up storing both container bases and lids for each container size and container type with all the risk of running short of one item or getting the wrong lid or having a bad lid fit.

In addition, two-piece containers are generally held together by closure mechanisms that rely generally on an effective friction fit between the container and the lid. Oftentimes the closure mechanism is not secure enough for general carrying convenience and take-out situations. Having a securely latched container-lid assembly has been a common desire for food related industries, restaurants, caterers, institutional food service establishments, hospital cafeterias, and households for a variety of reasons and situations. With today's busy lifestyle, situations requiring a securely latched container assembly are encountered in everyday life particularly when food is being delivered to household and commercial customers, or while it is being carried to work or other locations, during travel, or on airplanes.

Thus, there is a need for a container-lid assembly that—overcomes the disadvantages associated with existing one-piece and two-piece containers; preserves the upscale image of the caterer, restaurant or other food service establishment; and in addition, provides the convenience of a hingeable container-lid assembly that can be securely latched for take-out or transportation purposes and yet allows the lid to be readily separated from the container-lid assembly while eating out of the container, thereby facilitating the use of the container as a dining-dish. These and other needs as shall hereinafter appear are met by the container-lid assembly of the present invention.

BRIEF SUMMARY OF THE INVENTION

Accordingly, the present invention overcomes the problems and shortcomings of one-piece hinged food containers and two-piece base and lid containers and provides a disposable food container assembly wherein the base and lid can be hingeably connected and mutually latched in a reversible manner.

Another embodiment of the invention is to provide an improved and novel securing mechanism for retaining the container base and lid securely and effectively closed by providing a plurality of integral hinge/latch combinations, along the rim of the container base and the corresponding superjacent rim of the lid that can be cooperatively engaged in a mutually latched relationship.

Still another embodiment of the invention is to simplify inventory for a food service establishment by providing a multifunctional container base that can be utilized singly for eat-in service; or, can be combined with another identical container base to provide a lidded container assembly for take-out service.

Yet a further embodiment of the invention is to provide a multifunctional plate, which can be used as a dining plate that can in addition be converted into a take-out package by inverting and fitting a second plate thereon in a mutually latched relationship.

Still another embodiment of the invention is to provide a multifunctional container base that can be employed both as a container base and also as a container lid.

Yet another embodiment of the invention is to provide two structurally identical container bases, which are adapted for mutual engagement and are referred to respectively as first container base and second container base, wherein the second container base is disposed in an inverted and superjacent relationship to the first container base and serves as the container lid. Each container base has at least one integral hinge member disposed along a side thereof, and at least one integral latch member disposed along an opposite side thereof. The integral hinge member of the first container base is adapted for cooperatively engaging/latching with the integral latch member of the second container base, and connecting the first and second container bases in a mutually hingeable relationship. The integral latch member of the first container base is adapted for cooperatively engaging/latching with the integral hinge member of the second container base for retaining the container assembly formed by the first and second container bases securely closed.

An additional embodiment of the invention is to provide a take-out container assembly wherein the base and the lid are held securely closed by a first and a second set of hinge/latch combinations; wherein unlatching of the first set of hinge/latch combination enables the lid to pivot about the second set of hinge/latch combination; and wherein unlatching the second set of hinge/latch combination allows the lid to be separated from the container base.

Still another embodiment of the invention is to provide a take-out container assembly wherein the base and the lid are held securely closed by a first hinge/latch combination and a second hinge/latch combination; wherein either of the two hinge/latch combinations can be unlatched independent of the other; and wherein, unlatching/opening of any of the hinge/latch combinations enables the lid to pivot about the other closed hinge/latch combination.

Still another embodiment of the invention is to provide a take-out container assembly wherein the container base and the container lid are held closed along their respective rim interfaces at a first location along one side and at a second location along an opposite side. The first closure mechanism for securely latching the container lid and the base, at the first location, comprises a pivotable hinge flap integrally attached to the container base; the hinge flap includes a plurality of cavities, slots or holes that are adapted for cooperatively engaging/latching with a corresponding plurality of protruding snap-in members, projections or cylindrical buttons integrally attached to the container lid. The second closure mechanism, at the second location, comprises a pivotable hinge flap integrally attached to the container lid; the hinge flap includes a plurality of cavities, slots or holes that are adapted for cooperatively engaging/latching with a corresponding plurality of protruding snap-in members or cylindrical buttons which are integrally attached to the container base. At the first location, the hinge flap attached to the container base pivots upwardly to engage with the protruding snap-in members, projections or cylindrical buttons, which are integrally attached to the container lid. In contrast, at the second location, the hinge flap attached to the container lid pivots downwardly to engage with the protruding snap-in members or cylindrical buttons which are integral to the container base.

Yet another embodiment of the invention is to provide a container assembly comprising a base and lid, which can be mutually latched in a secure manner and can be reversibly separated into a hingeable assembly and further reversibly separated into base and lid components.

To achieve the foregoing and other embodiments of the invention, a container assembly formed by two at least "structurally identical" container bases is provided, wherein a first container base serves as the container base for holding food while a second container base is inverted over the first container base and employed as a container lid. It is noteworthy that the container base and container lid are at least "structurally identical" and could be "completely identical in structural and non-structural aspects." Alternately, the container base and the corresponding container lid could be "structurally identical but dissimilar in non-structural aspects"; for example, consistent with typical package configurations—the container base could be made of a pigmented plastic material in an opaque color such as black, while the container lid could be made of a light transmitting plastic material in a naturally clear or a tinted configuration. It would also be appreciated by those skilled in the art that plastic articles can be produced in a variety of colors on the same tooling and production equipment by incorporating a color masterbatch in a thermoplastic resin, therefore, a variety of color effects can be imparted to a plastic article without affecting its physical structure or mechanical function. Thus, while the base and lid may be the same color, the present invention allows any color combination. Furthermore, the lid and/or base can be provided with any form of embossment or printing or engraving for displaying a logo, or a trademark or a decorative pattern/design as is known in the art.

A typical container base, according to this embodiment, comprises a bottom wall; a sidewall; and, a peripheral rim having a ridge portion, a groove portion, a hinge flap and a locking area. The ridge portion of the first container base is adapted to engage with the groove portion of the second container base, while the groove portion of the first container base is adapted to engage with and receive the ridge portion of the second container base. The hinge flap of the first container base is adapted to latch with the locking area of the second container base and correspondingly the locking area of the second container base is adapted to retain the hinge flap of the first container base in a latched position. Similarly, the locking area of the first container base is adapted to engage with the hinge flap of the second container base and to retain it in a latched position.

Still other features and advantages of the present invention will become readily apparent to those skilled in this art from the following detailed description, wherein we have shown and described only a few embodiments of the invention, simply by way of illustration contemplated by us in carrying out our invention. As will be realized, the invention is capable of other and different embodiments, and its several details are capable of modifications in various obvious respects, all without departing from the invention.

For the sake of example, according to a variant embodiment of the invention, at least the mating portions of the container base and lid (which primarily comprise the rim, hinge and latch portions) are rendered structurally identical and are adapted for cooperatively engaging and latching mutually. Herein, only the mating portions of the container base and lid interface need to be structurally identical, while the body of the container base and the container lid can be dissimilar in both structure and appearance.

The features and advantages described herein are not all-inclusive and, in particular, many additional features and advantages will be apparent to one of ordinary skill in the art in view of the drawings, specification, and examples of claims. Moreover, it should be noted that the language used in the specification has been principally selected for readability and instructional purposes, and not to limit the scope of the inventive subject matter.

BRIEF DESCRIPTION OF THE DRAWINGS

The invention will be better understood upon reading the following Detailed Description in conjunction with the drawings in which.

DETAILED DESCRIPTION

As will readily become apparent from the foregoing description, a hingeable and mutually securable double-dish container structure that can be reversibly assembled according to the present invention provides several economic advantages over other containers.

A particular advantage of the containers made according to an embodiment of the present invention is the ability to offer a pre-fastened hingeable lidded-container packed in its open but assembled format. This provides the food service establishment with containers and lids that match and are stocked as one combined or hinged container with no risk of running short of one component or of having the wrong lid in stock. However, with this embodiment of the invention the ultimate consumer can —not only carry the food securely to another venue but once at that venue can remove the lid and eat from a more aesthetically pleasing container without the nuisance of a lid flapping around the table setting. Indeed the lid may be removed and as it is structurally identical to the container it can easily be stacked under the food container to save table space. This effectively resolves the aesthetic and clutter issues related to a one-piece hinged container. However, the caterer or food service establishment can also easily break apart a container and lid into the two elements and serve a consumer (perhaps an eat-in diner) with a container only. In this way they do not incur the waste of providing a lid that is not really required or incur the cost of supplying the lid. The lid that was separated from the container is, as explained herein, structurally identical to the container and can therefore be used as a container for the next eat-in customer or once two lids have been discarded they can be used together to form a new container lid structure for a take-out customer.

For illustrative purposes, in a typical deli that might have 50% eat-in and 50% eat-out customers, a hinged lid container according to the present invention will save 25% of all packaging used, reduce waste, offer eat-in customers a less cluttered and more aesthetically pleasing presentation. The present invention also offers take-out customers a more secure, more user friendly, more upscale and more reusable container. The following description, of one or more embodiments, in conjunction with the accompanying drawings is offered as illustrative of the invention but not restrictive of the scope of the invention.

Figure 7:
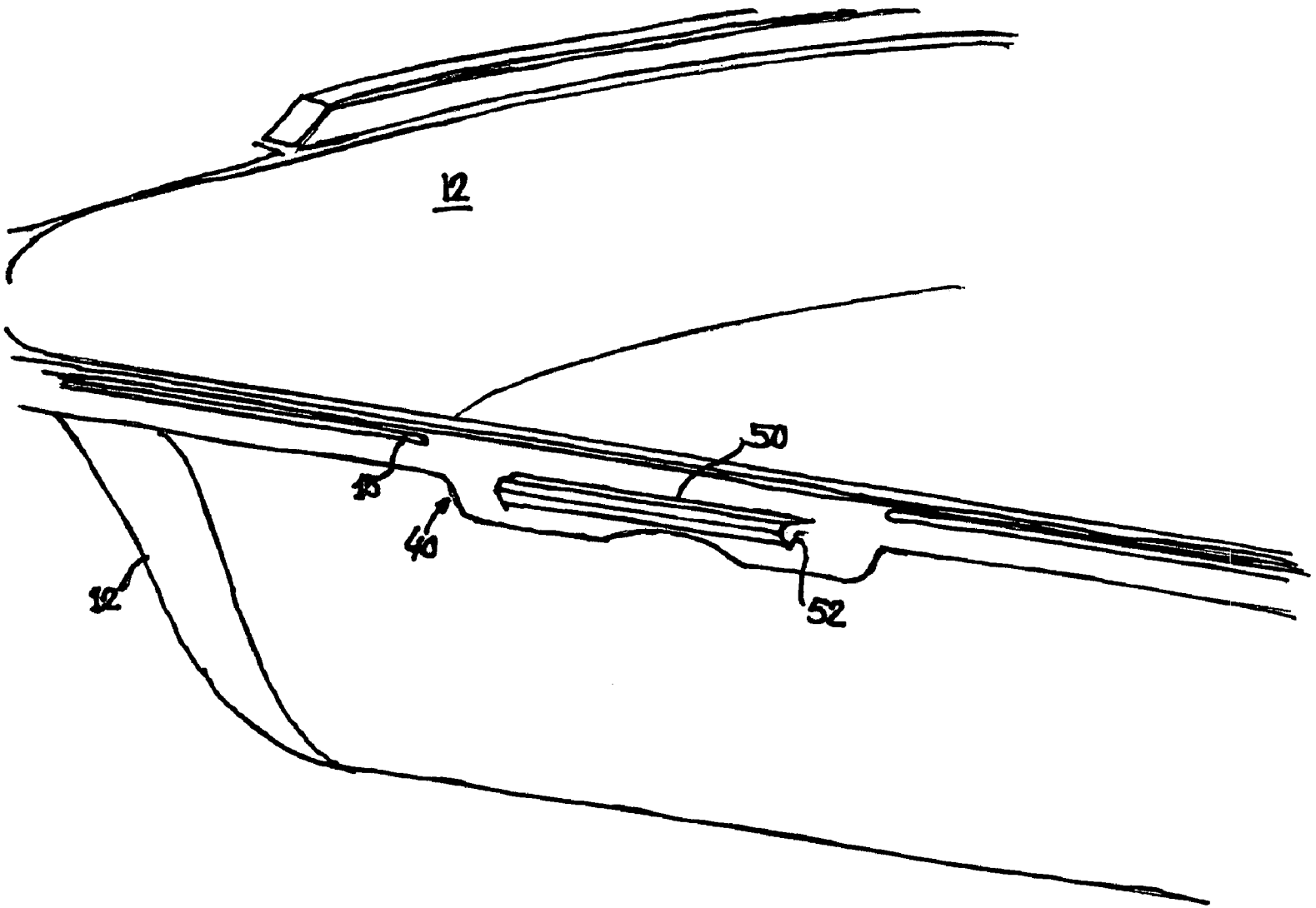
FIG. 7 is an enlarged view of container base 10 showing locking area 40 according to an alternate embodiment of the invention.
Figure 8:
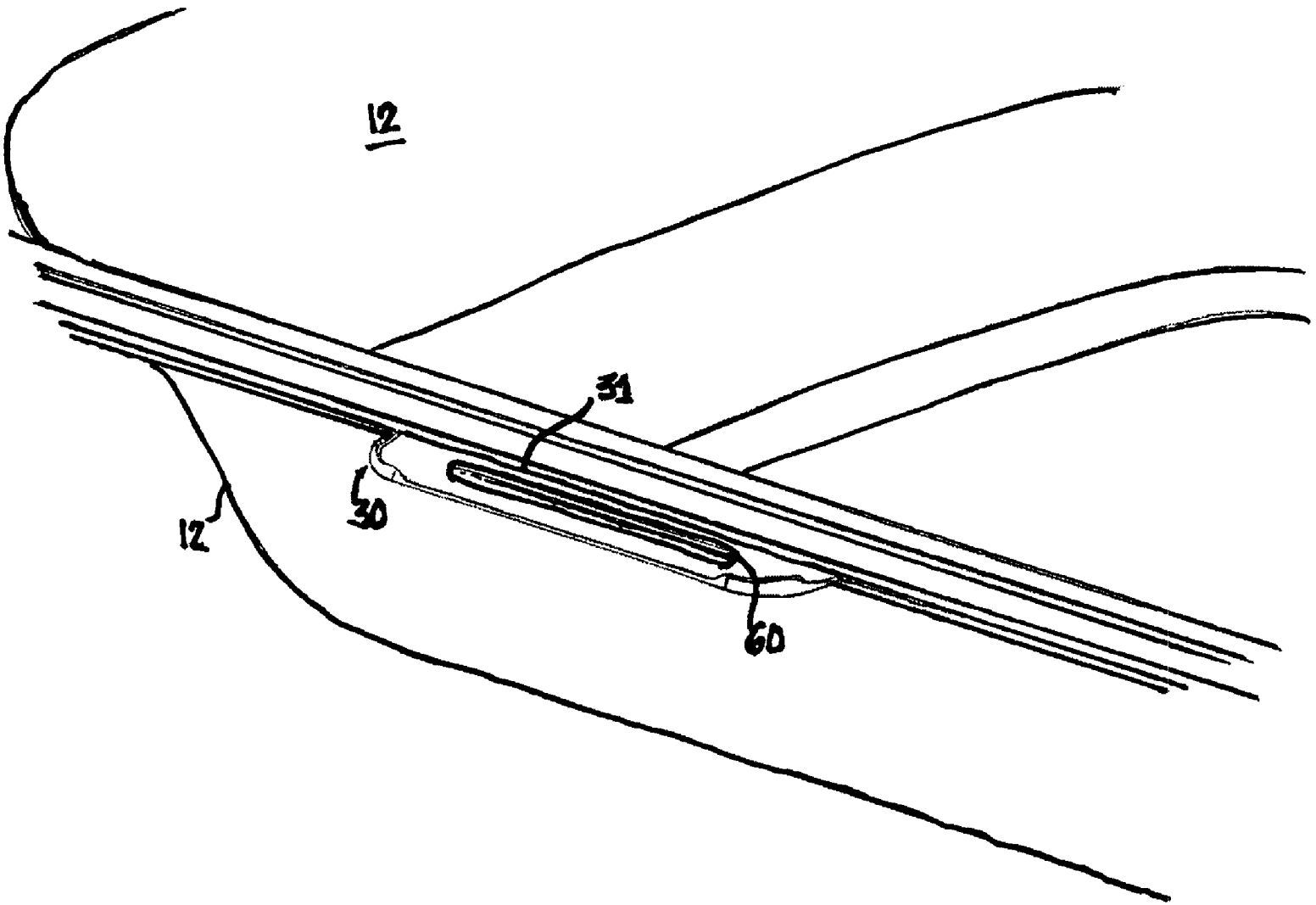
FIG. 8 is an enlarged view of container base 10 showing hinge flap 30 according to an alternate embodiment of the invention.
Figure 9:
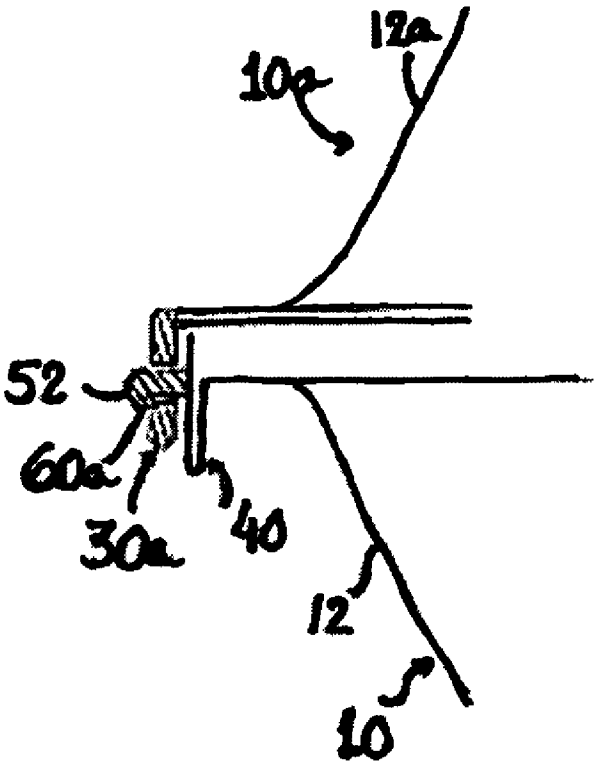
FIG. 9 is a side view of container base 10 and container lid 10*a* shown in a superjacent relationship according to an alternate embodiment of the present invention.

A container base designated by reference numeral 10, according to an embodiment of the invention, is shown in FIGS. 1 through 6, wherein like reference numerals represent like parts. An alternate embodiment of the invention is shown in FIGS. 7 through 9. Another container base that is structurally identical to container base 10 can be inverted over container base 10 and arranged in a superjacent relationship thereto and engaged therewith to serve as a container lid. For the purposes of discussion herein, the "inverted container base" is referred to as the "container lid" and designated by reference numeral 10*a*. Similarly, all parts of container lid 10*a* are denoted by placing alphabet character "a" at the end of the reference numeral, which denotes the corresponding counterpart on container base 10. Container lid 10*a* is shown in combination with container base 10 in FIGS. 5, 6 and 9.

In one embodiment the container base and lid are structurally identical however it is within the scope of the invention to offer variations to the base and/or lid such while still enabling the functional coupling described herein. For example, the depth of the lid or base may be deeper in certain embodiments but maintaining the same coupling engagement described herein. There are other embodiment contemplated such as varying color, and including logos or designs, however such aspects are not considered structural modifications.

Figure 1:
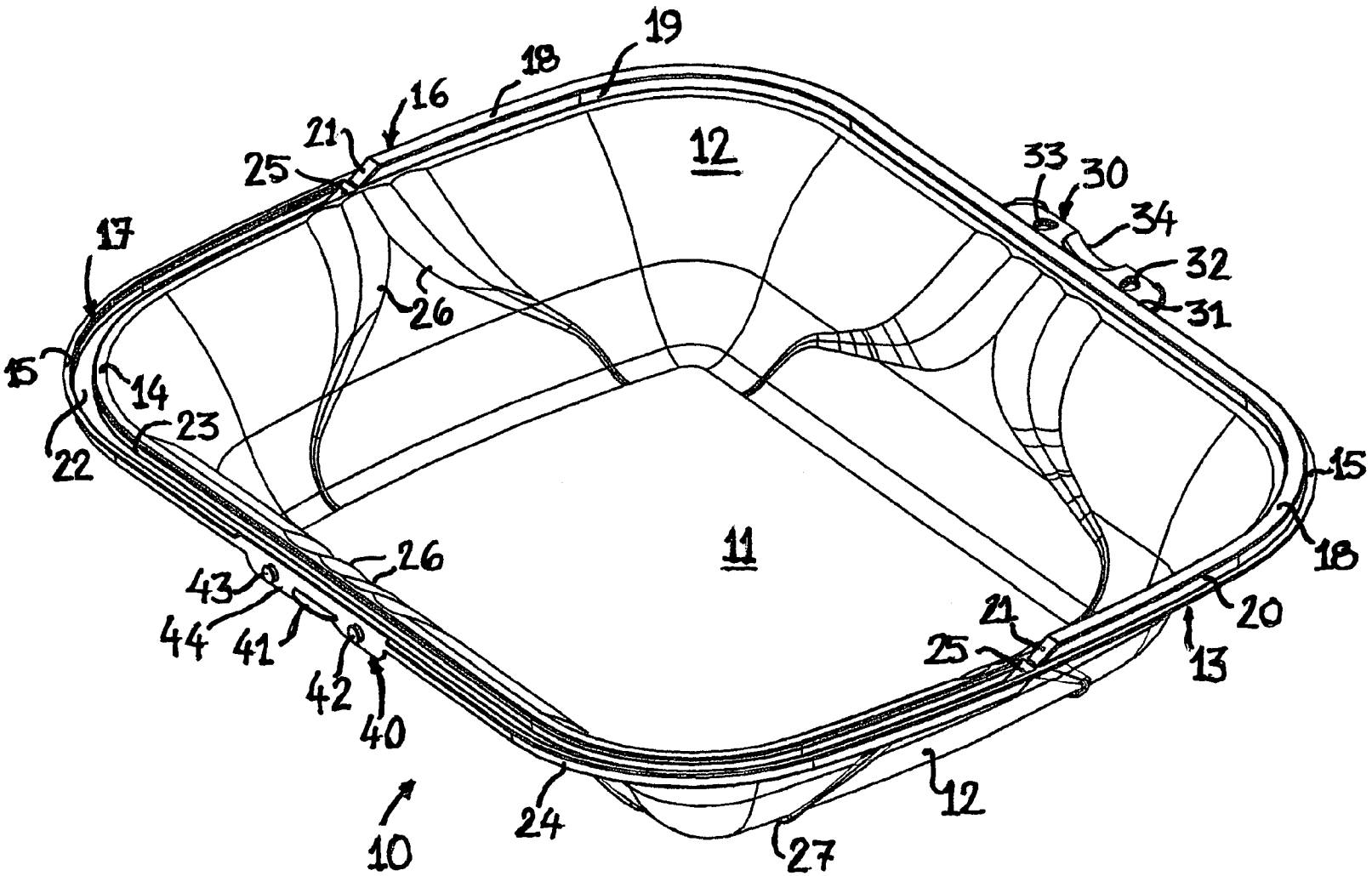
FIG. 1 is a perspective view of container base 10 in accordance with an embodiment of the present invention.
Figure 2:
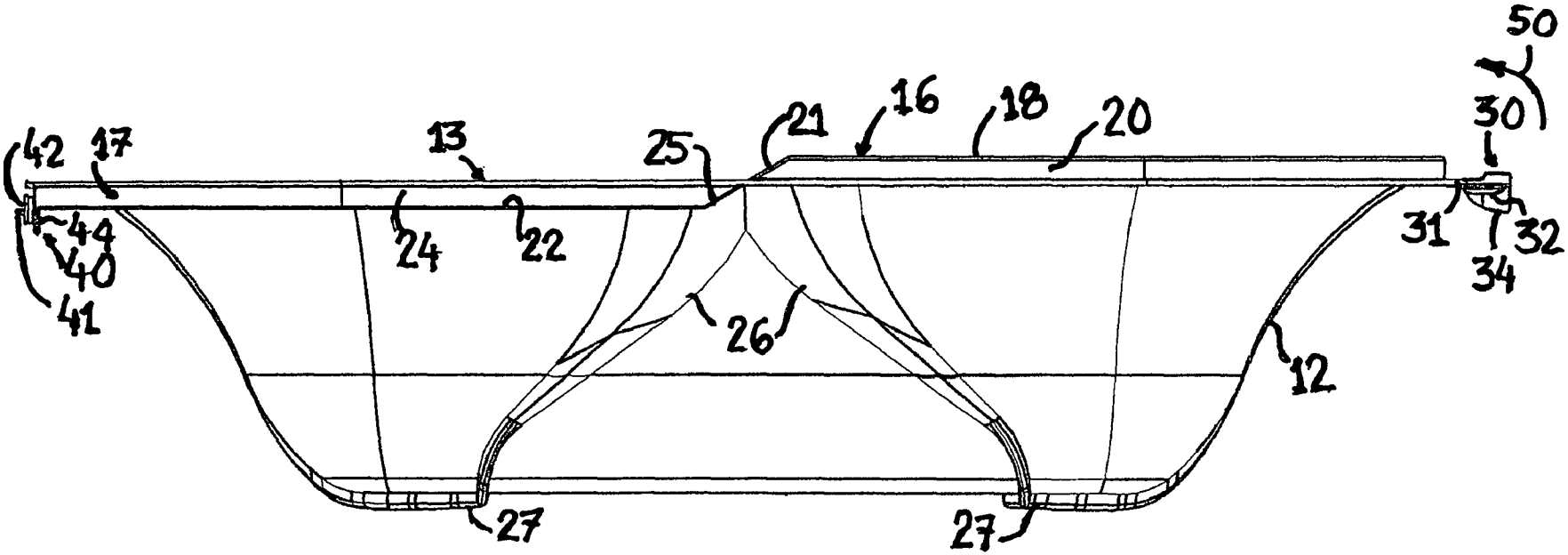
FIG. 2 is a side view of container base 10 in accordance with an embodiment of the invention.

As shown in FIG. 1, the main body of the container base 10 integrally comprises a generally planar bottom wall 11; a generally tapering sidewall 12; and, an outwardly extending peripheral rim 13 around container base 10. Sidewall 12 diverges upwardly from bottom wall 11 and rolls outwardly to define a substantially horizontal inner peripheral lip 14 integral with peripheral rim 13. In addition to inner peripheral lip 14, peripheral rim 13 integrally comprises an outer peripheral lip 15; a ridge portion 16; a groove portion 17; a hinge flap 30; and a locking area 40. According to one embodiment of the invention, inner peripheral lip 14 and outer peripheral lip 15 are coplanar and substantially horizontal. Based on the perspective view of FIG. 1, it should be readily apparent that the relative terminology such as 'horizontal' is for illustrative purposes in describing the invention and can more generally be described as planar. Furthermore modifiers such as 'generally' and 'substantially' are intended to be construed liberally and allowed to negate the meaning of the words it modifies. Thus, for example, 'generally planar' and 'substantially planar' are intended to allow for irregular deviations from perfectly flat surface and to broaden planar to encompass curved and other non-planar surfaces.

The ridge portion 16 and groove portion 17 are arranged to contour along the peripheral rim 13 in-between inner peripheral lip 14 and outer peripheral lip 15. The ridge portion 16 protrudes upwardly from the substantially horizontal plane containing inner peripheral lip 14 and outer peripheral lip 15. The ridge portion 16 comprises an inner ridge sidewall 19 protruding upwardly from the inner peripheral lip 14, and an outer ridge sidewall 20 protruding upwardly from the outer peripheral lip 15. A substantially horizontal ridge top wall 18 bridges the upwardly extending ends of inner and outer ridge sidewalls 19 and 20 respectively. At either end of ridge portion 16, ridge top wall 18 and ridge sidewalls 19 and 20 slope downwardly to merge with the substantially horizontal plane, containing inner peripheral lip 14 and outer peripheral lip 15, and terminate into wedge shaped terminal ends 21. The ridge portion 16 is adapted for forming a male sealing channel extending approximately one half the length of the peripheral rim 13.

The groove portion 17 protrudes downwardly from the substantially horizontal plane containing inner peripheral lip 14 and outer peripheral lip 15. The groove portion 17 comprises an inner groove sidewall 23 extending downwardly from inner peripheral lip 14, and an outer groove sidewall 24 extending downwardly from the outer peripheral lip 15. A substantially horizontal groove bottom wall 22, bridges inner and outer groove sidewalls 23 and 24 respectively. At either end of groove portion 17, groove bottom wall 22 and groove sidewalls 23 and 24 slope upwardly to merge with the substantially horizontal plane containing inner peripheral rim 14 and outer peripheral lip 15 and terminate into triangulate recessed ends 25. The groove portion 17 is adapted for forming a recessed sealing channel extending approximately one half of the length of the peripheral rim 13. According to one embodiment the ridge portion 16 and groove portion 17 are of approximately equal length with each extending along about one half the length of peripheral rim 13.

Figure 5:
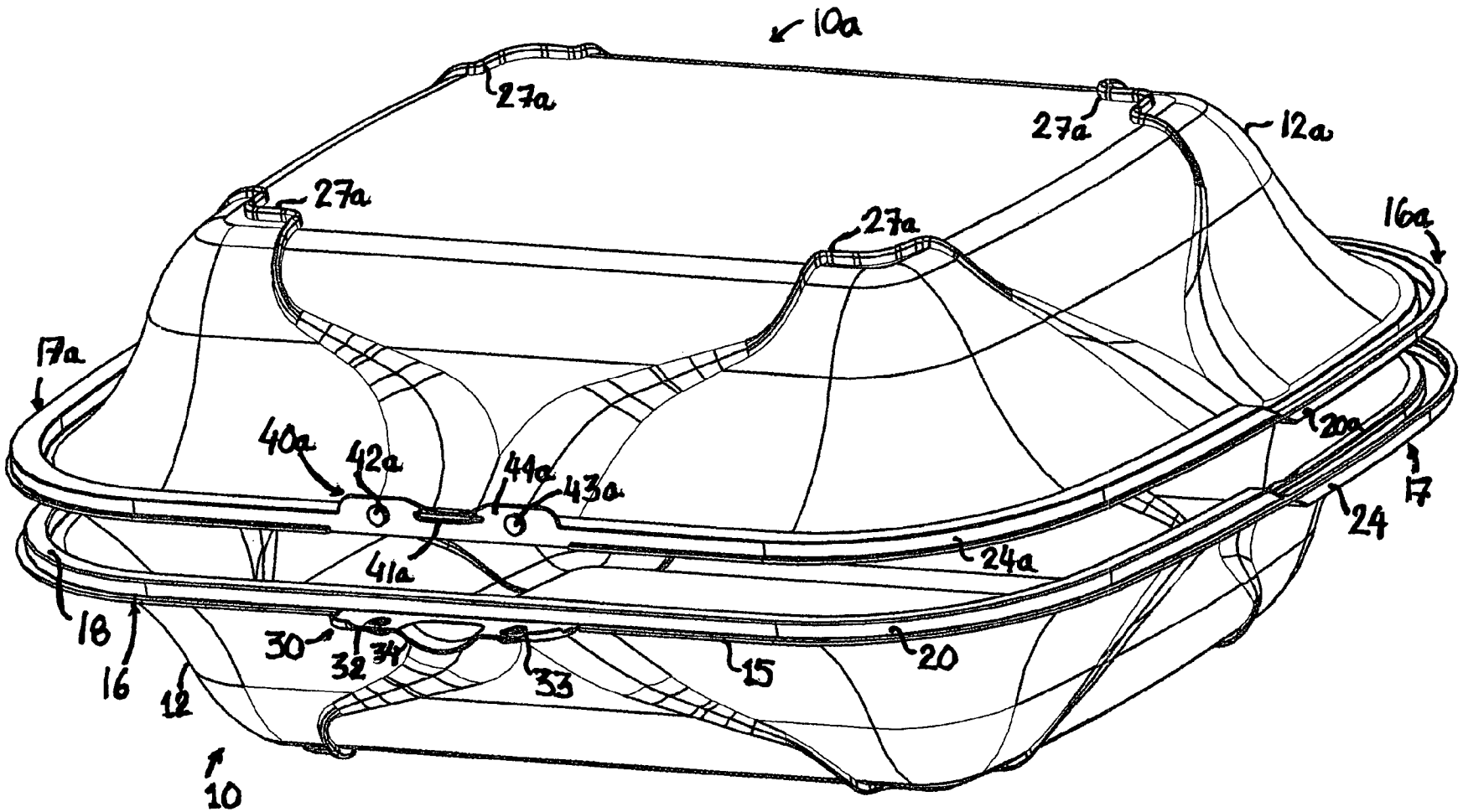
FIG. 5 is a perspective view of container base 10 and container lid 10*a* according to an embodiment of the present invention.
Figure 6:
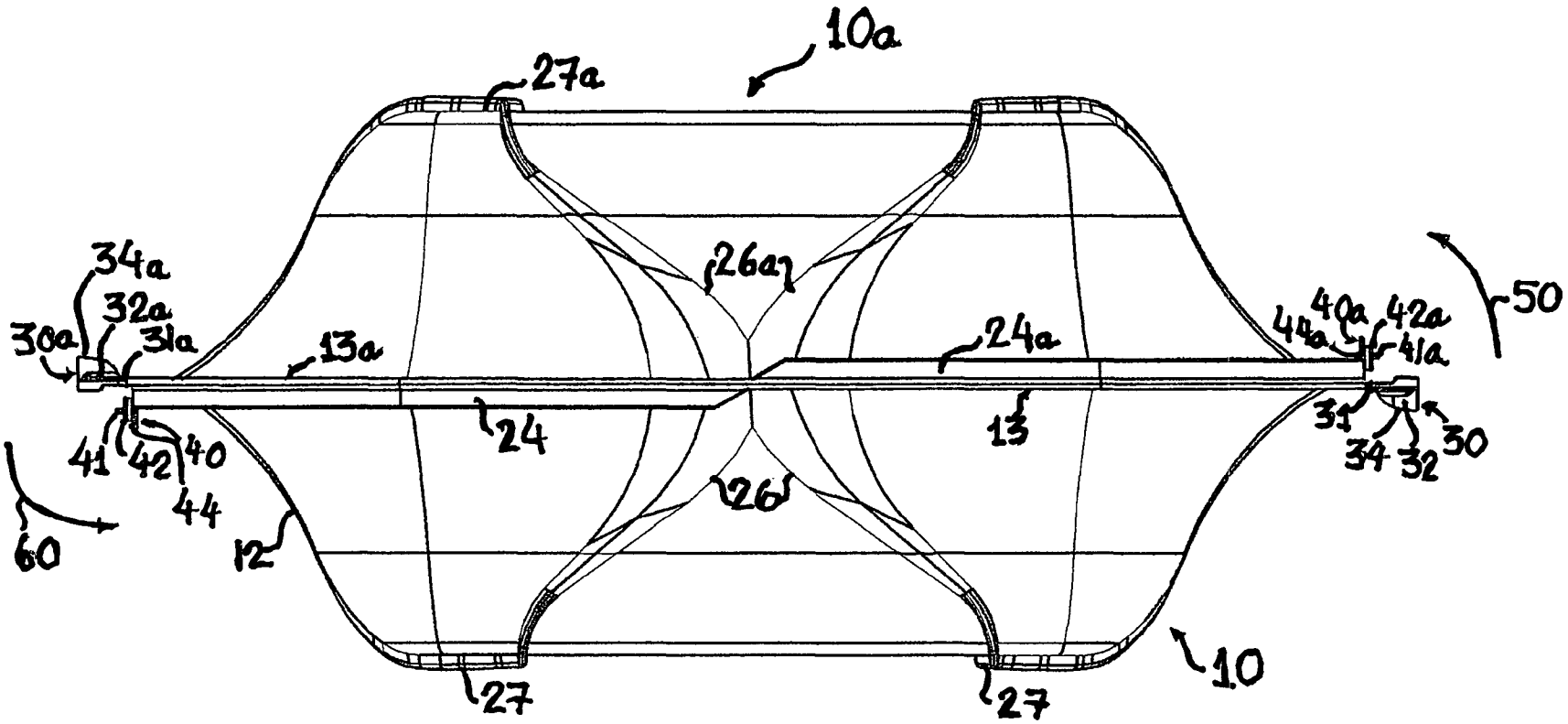
FIG. 6 is a side view of the container base 10 and container lid 10*a* shown in a superjacent relationship according to an embodiment of the present invention.

It will be realized by those skilled in the art that the ridge portion 16 and groove portion 17 of peripheral rim 13 are structured and adapted for engaging and detachably fitting container base 10 with structurally identical container lid 10*a* as shown in FIGS. 5 and 6, wherein ridge portion 16 of container base 10 engages with groove portion 17*a* of container lid 10*a*; and groove portion 17 of container base 10 engages with ridge portion 16*a* of container lid 10*a*.

Figure 4:
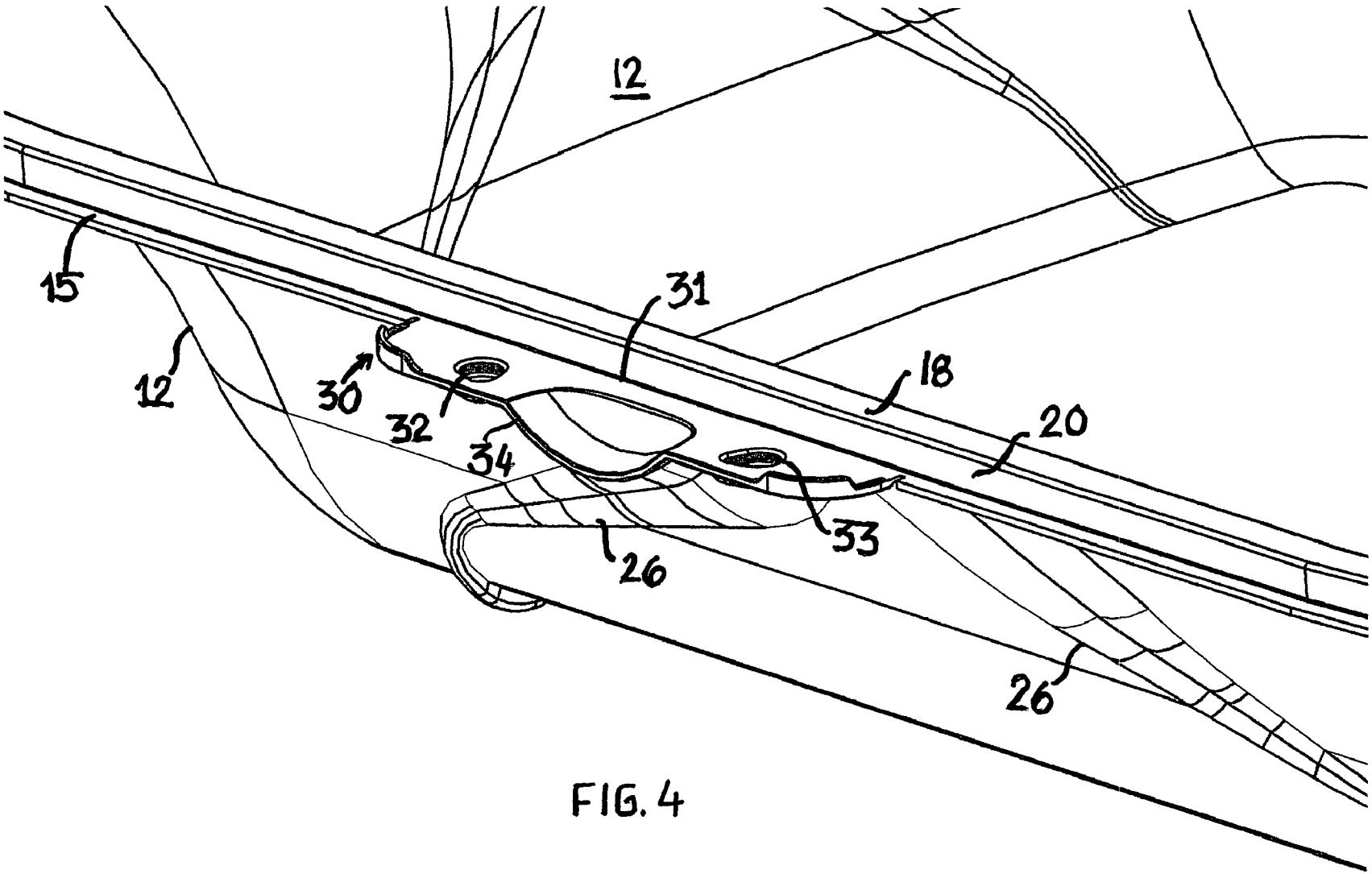
FIG. 4 is an enlarged view of container base 10 showing hinge flap 30 according to an embodiment of the invention.

Along a side of container 10 that includes the ridge portion 16, hinge flap 30 extends outwardly from a generally straight segment of the substantially horizontal outer peripheral lip 15. In its non-engaged configuration, hinge flap 30 is substantially horizontal. As best shown in FIG. 4, hinge flap 30 comprises an integral hinge axis 31, an ergonomic concave tab 34 for facilitating handling; and a pair of snap-in cavities 32 and 33. Although, not shown separately for container lid 10*a*, hinge flap 30*a* of container lid 10*a* comprises an integral hinge axis 31*a*, an ergonomic concave tab 34*a*, and a pair of snap-in cavities 32*a* and 33*a*. Hinge flap 30 is adapted for pivoting upwardly about its hinge axis 31 in direction shown by arrow 50 in FIG. 6 and engaging with locking area 40*a* of container lid 10*a*. Hinge flap 30*a* is adapted for pivoting downwardly about its hinge axis 31*a* in the direction shown by arrow 60 in FIG. 6 and engaging with locking area 40 of container base 10. For descriptive purposes, the integral hinge axis 31 and 31*a* may be considered a living hinge.

Figure 3:
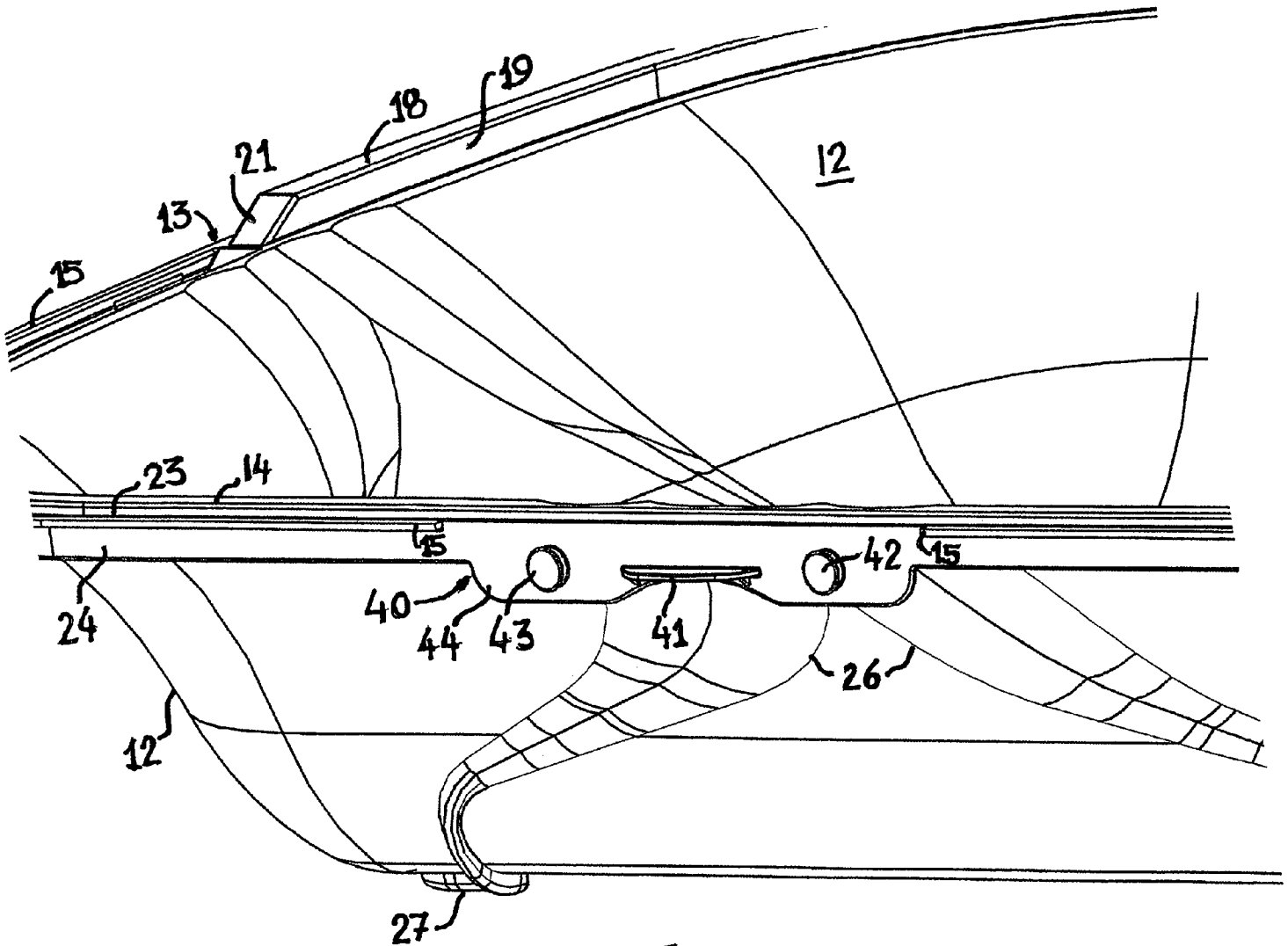
FIG. 3 is an enlarged view of container base 10 showing locking area 40 according to an embodiment of the invention.

Locking area 40 is located directly opposite to hinge flap 30 along a side of container 10 that includes the groove portion 17. As best shown in FIG. 3, locking area 40 is integrally connected to outer groove sidewall 24 with a downwardly extending skirt 44, and is adapted for engagement with hinge flap 30*a* of container lid 10*a*. To facilitate mutual engagement between locking area 40 and hinge flap 30*a* and prevent any interference therebetween, the outer peripheral lip 15 is truncated in the segment corresponding to the locking area 40. Locking area 40 includes an outwardly extending access tab 41, and a pair of outwardly extending latching projections 42 and 43. Although, not shown separately for the container lid 10*a*, locking area 40*a* of container lid 10*a* includes an outwardly extending access tab 41*a*, and a pair of latching projection 42*a* and 43*a*.

Latching projections 42 and 43 of container base 10, are adapted for engaging and latching with snap-in cavities 32*a* and 33*a* of container lid 10*a*; while latching projections 42*a* and 43*a* of container lid 10*a* are adapted for engaging and latching with snap-in cavities 32 and 33 of container base 10. Latching projections 42, 43, 42*a* and 43*a* and snap-in cavities 32, 33, 32*a* and 33*a* are generally adapted to have a mutually cooperating snap-fit geometry respectively. In one embodiment of the invention the latching projections 42, 43, 42*a* and 43*a* are in the general shape of flared buttons, however other shapes are within the scope of the invention. Those skilled in the art will readily appreciate that other integral fastening mechanisms are within the scope of the invention.

Sidewall 12 may include ornamental features in the form of exemplary fluted portion 26 in FIGS. 1 through 6. Container base 10 also includes a plurality of stacking lugs 27 for securely supporting and stacking a plurality of container assemblies formed by container base 10 and container lid 10*a* as best shown in FIG. 5.

It will be apparent to those skilled in the art that the container base 10 and container lid 10*a* can be securely and mutually latched by pivoting hinge flaps 30 and 30*a* and latching them respectively with locking areas 40*a* and 40. Hinge flap 30 of container base 10 pivots upwardly to latch with locking area 40*a* of container lid 10*a* as shown by arrow 50 in FIG. 6; while the hinge flap 30*a* of container lid 10*a* pivots downwardly to latch with locking area 40 of container base 10 as shown by arrow 60 in FIG. 6.

Once the container base 10 and lid 10*a* are mutually latched and secured the container lid assembly can be hingeably opened at either end. In one of the embodiments of the invention, the container assembly can be opened and pivoted by unlatching hinge flap 30 in the direction opposite to arrow 50 and pivoting the lid 10*a* about hinge axis 31*a* of hinge flap 30*a*. Alternately, the container assembly can be opened and pivoted by unlatching hinge flap 30*a* in the direction opposite to arrow 60 and pivoting the lid 10*a* about hinge axis 31 of hinge flap 30.

The container base 10 and container lid 10*a* can be made of a variety of materials and by a variety of processes. Container base 10 and container lid 10*a* are made in one embodiment by injection molding; however, it will be apparent to those skilled in the art that the containers of the present invention can be readily adapted for manufacture by other known methods for processing plastics including thermoforming. Container base 10 and container lid 10*a* can be made of a suitable thermoplastic material which can be processed by common polymer processing methods known in the art such as thermoforming or injection molding. The choice of a thermoplastic resin is typically governed by a variety of factors including cost, resin processability and the functional requirements of the container. The presence of an integral hinge typically employs a thermoplastic resin that is adapted for sustaining a living hinge. In one of the embodiments of the invention the containers are made from a suitable grade of polypropylene resin.

Although the shape of the containers shown in FIGS. 1 through 6 is referred to generally as rectangular, it will be appreciated by those skilled in the art that numerous shape modifications can be made to the general outline of the container base 10 in accordance with food types to be placed therein, market preferences, and the need for differentiation in the marketplace. In the generally rectangular form for a container base 10, as shown in FIG. 1, the sidewall 12 can be further defined in this perspective as a right sidewall, a left sidewall, a front sidewall and a rear sidewall. The sidewalls 12 are integrally coupled to the bottom wall 11 and the peripheral rim 13 extends about the entire periphery of the sidewalls of the container base or lid 10 and in the perspective view of FIG. 1 the parts of peripheral rim 13 corresponding to the right, left, front and rear sidewalls can be respectively defined as a right rim, a left rim, a front rim, and a rear rim. The left sidewall and left rim are oriented opposing right sidewall and right rim respectively; while the front sidewall and front rim are oriented opposing the rear sidewall and rear rim respectively. The rear rim has a hinge flap 30 while the front rim has a locking area 40. The hinge flap 30 and locking area 40 are arranged in a mutually opposing orientation such that a mating second container base having a second hinge flap and a second locking area can be joined, attached, engaged or coupled to the first container base by latching hinge flap 30 with second locking area and locking area 40 with second hinge flap and thereby connectively coupling and securely fastening the two separate container bases and forming a closed container assembly. The container bases 10 in one embodiment are made in such a manner that they can only be securely fastened in a single position which facilitates the coupling for any end user.

It will be realized that the specific construction of hinge flap 30 and locking area 40 as shown in FIGS. 1 through 6 is purported to be illustrative of the invention and not restrictive to the scope of the invention. Accordingly, FIGS. 7, 8 and 9 show another construction of a hinge flap and locking area according to an alternate embodiment of the invention.

FIG. 7 shows container base 10 wherein locking area 40 comprises an outwardly protruding snap-fit cantilever 50 having a frontal snap-fit edge 52. FIG. 8 shows hinge flap 30 having an open receiving slot 60. The locking area 40 of container base 10 is adapted for mutual engagement with hinge flap 30*a* of container lid 10*a*. Similarly, hinge flap 30 of container base 10 is adapted for mutual engagement with locking area 40*a* of container lid 10*a*.

FIG. 9 shows locking area 40 of container base 10 in a latched position with hinge flap 30*a*. The latching is accomplished by pivoting hinge flap 30*a* of container lid 10*a* downwardly and threading the frontal snap-fit edge 52 of outwardly protruding snap-fit cantilever 50 through open receiving slot 60*a* provided within hinge flap 30*a*. Accordingly, hinge flap 30*a* of container lid 10*a* has an open receiving slot 60*a* which is suitable dimensioned and adapted to interact with outwardly protruding snap-fit cantilever 50 and to allow frontal snap-fit edge 52 to be threaded therethrough. Although, not shown separately, hinge flap 30 of container base 10 pivots upwardly to allow open receiving slot 60 to thread through frontal snap-fit edge 52*a* and engage with outwardly protruding snap-fit cantilever 50*a* of locking area 40*a* of container lid 10*a*.

An advantage of the present invention is that both container base 10 and lid 10*a* are adapted for containing food and can also be used independently as two separate container bases when a non-lidded food dish is desired. Thus, in certain situation only one container base can be used for serving food without incurring additional costs associated with a permanently attached and hinged lid. Also, the two container bases can be assembled or disassembled upon demand.

Changes, modifications, adaptations and alterations in the specifically described embodiments can be carried out without departing from the spirit and scope of the invention. In particular in any of the embodiments above, alternate container-in-container arrangements, multiple layers of insulating shells or inserts, double wall lid structures and radiation blocking liners, layers or treatments are also within the scope of the invention.

The foregoing description of the embodiments of the invention has been presented for the purposes of illustration and description. It is not intended to be exhaustive or to limit the invention to the precise form disclosed. Accordingly, the drawing and description are to be regarded as illustrative in nature, and not as restrictive. Many modifications and variations are possible in light of this disclosure. The advantages of the invention may be further realized and attained by means of the instrumentalities and combinations particularly pointed out in the appended claims.

What is claimed is:

1. A food container assembly, comprising:

a first container base and a second container base; said first container base comprising a first peripheral rim, a first hinge flap and a first locking area; said second container base comprising a second peripheral rim, a second hinge flap and a second locking area; said first hinge flap, said first locking area and said first peripheral rim of said first container base being structurally identical respectively to said second hinge flap, said second locking area, and said second peripheral rim of said second container base;

said first hinge flap being engageable with said second locking area, thereby hingedly attaching said first container base to said second container base;

said first and second container bases being rotatable about said first hinge flap over a range of at least about 180 degrees between an open position and a closed position;

said first peripheral rim of said first container base being engageable with said second peripheral rim of said second container base in said closed position; and said first locking area being engageable with said second hinge flap so as to latch said food container assembly in said closed position;

said latched food container assembly being openable from said closed position by disengagement of one of said first hinge flap from said second locking area and said second hinge flap from said first locking area; and rotation of one of said first container base and said second container base; said food container assembly when in said open position being substantially nestable within an open second food container assembly of identical construction; and said food container assembly being separable by disengagement of said first and second hinge flaps from said second and first locking areas respectively into a first container base and a second container base.

2. The food container assembly according to claim 1, wherein said container base is structurally identical to said second container base.

3. The food container assembly according to claim 1, wherein said first hinge flap comprises at least one opening.

4. The food container assembly according to claim 1, wherein said first locking area comprises at least one snap-fit member.

5. The food container assembly according to claim 1, wherein said first hinge flap comprises at least one slotted opening and said first locking area comprises at least one outwardly protruding snap-fit cantilever.

6. The food container assembly according to claim 1, wherein said first peripheral rim comprises a first ridge portion and a first groove portion.

7. The food container assembly according to claim 1, wherein said first container base and said second container base are injection molded from a thermoplastic material.

8. The food container assembly according to claim 1, wherein said first container base and said second container base are constructed from polypropylene resin.

9. A container assembly, comprising:

a container base having a base peripheral rim, a first hinge flap and a first locking area;

a container lid having a lid peripheral rim, a second hinge flap and a second locking area, said base peripheral rim, said first hinge flap and said first locking area of said container base being structurally identical respectively to said lid peripheral rim, said second hinge flap and said second locking area of said container lid, wherein said container lid is adapted for engagement with said container base and being securely fastened thereto;

said base peripheral rim being adapted for cooperatively engaging with said lid peripheral rim;

said first hinge flap of said container base being adapted for engaging with said second locking area of said container lid thereby creating a first hinge-latch combination; and said second hinge flap of said container lid being adapted for engaging with said first locking area of said container base thereby creating a second hinge-latch combination;

said container lid being rotatable over a range of at least about 180 degrees about either of said first hinge latch combination and said second hinge latch combination between an open configuration and a closed configuration;

said food container assembly when in said open configuration being substantially nestable within an open second food container assembly of identical construction; and said container lid being separable from said container base by disengaging said first and second hinge latch combinations.

10. The container assembly according to claim 9, wherein said container lid is at least structurally identical to said container base.

11. The container assembly according to claim 9, wherein said base peripheral rim includes a base ridge portion and a base groove portion; said lid peripheral rim includes a lid ridge portion and a lid groove portion; and, wherein said base ridge portion is adapted for engagement with said lid groove portion, and said base groove portion is adapted for engagement with said lid ridge portion.

12. The container assembly according to claim 11, wherein said base ridge portion is at least structurally identical to said lid ridge portion; and said base groove portion is structurally identical to said lid groove portion.

13. The container assembly according to claim 9, wherein said container base is made from opaque material and said container lid is constructed from a light transmitting material.

14. The container assembly according to claim 9, wherein said container base and said container lid are injection molded utilizing the same mold.

15. A container assembly, comprising:

a first container base and a second container base, wherein said second container base is structurally identical to said first container base and is disposable in an inverted and superjacent relationship to said first container base and adapted for engagement therewith;

said first container base comprising at least one first hinge member disposed along a side thereof, and at least one first latch member disposed along an opposing side thereof; said second container base comprising at least one second hinge member disposed along a side thereof, and at least one second latch member disposed along an opposing side thereof;

said first hinge member of said first container base being adapted for cooperatively engaging and latching with said second latch member of said second container base, thereby providing a first hinge/latch combination and connecting said first and second container bases in a mutually hinged relationship; said first latch member of said first container base being adapted for cooperatively engaging and latching with said second hinge member of said second container base, thereby providing a second hinge/latch combination and connecting said first and second container bases in a mutually hinged relationship, said container assembly being securely closable by simultaneously engaging both said first hinge/latch combination and said second hinge/latch combination, whereby either of said first hinge/latch combination and said second hinge/latch combination can be unlatched to allow said second container base to pivot about the other hinge/latch combination over a range of at least about 180 degrees to a fully open position, said container assembly when in said open position being substantially nestable within an open second container assembly of identical construction; and wherein unlatching both of said first and second hinge/latch combinations renders said first and second container bases separable.

16. The container assembly according to claim 15, wherein said first container base comprises a first groove portion and a first ridge portion, said second container base comprises a second groove portion and a second ridge portion; and wherein said first groove portion is adapted for engaging with said second ridge portion, and said first ridge portion is adapted for engaging with said second groove portion.

17. A method for packaging and presenting food comprising:

providing a nested stack comprising a plurality of open food container assemblies, each of the open food container assemblies comprising a first container base and a second container base wherein the first container base comprises a first peripheral rim, a first hinge flap on one edge and a first locking area on an opposing edge, the second container base comprises a second peripheral rim, a second hinge flap and an opposing second locking area, and wherein the first hinge flap, the first locking area and the first peripheral rim of the first container base are structurally identical respectively to the second hinge flap, the second locking area, and the second peripheral rim of said second container base, each of the open food container assemblies having its first hinge flap engaged with its second locking area so as to hingedly attach the first and second container bases in an open position wherein the container bases are rotated at least about 180 degrees relative to each other, the open food container assemblies being stacked in a substantially nested configuration;

removing a selected food container assembly from a top of the nested stack;

placing food material in the first container base of the selected food container;

rotating the second container base of the selected food container about the first hinge flap and second locking area from the open position at least about 180 degrees to a closed position whereby the first peripheral rim of the first container base of the selected food container engages with the second peripheral rim of the second container base of the selected food container and the second container base functions as a lid to the first container base; and engaging the first locking area of the selected food container with the second hinge flap of the selected food container, whereby the food container bases are latched together in the closed position.

18. The method of claim 17, further comprising:

disengaging the first locking area from the second hinge flap whereby the food container bases are unlatched in the closed position;

rotating the second container base about the second locking area and first hinge flap from the closed position to the open position whereby the food material in the first container base is exposed;

disengaging the second locking area from the first hinge flap; and separating the second container base from the first container base.

* * * * *